US005366029A

United States Patent [19]

Beck, III

[11] Patent Number: 5,366,029

[45] Date of Patent: Nov. 22, 1994

[54] LARGE SHAFT OVER-REAMER APPARATUS AND METHOD

[76] Inventor: August H. Beck, III, 10 Hearthwood, San Antonio, Tex. 78248

[21] Appl. No.: 45,818

[22] Filed: Apr. 9, 1993

[51] Int. Cl.[5] ..... E21D 1/00

[52] U.S. Cl. ..... 175/53; 175/344; 175/406; 175/57

[58] Field of Search ..... 175/53, 344, 406

[56] References Cited

U.S. PATENT DOCUMENTS

| | | | |
|---|---|---|---|
| 3,638,740 | 2/1972 | Justman | 175/53 |
| 3,659,660 | 5/1972 | Conn | 175/53 |
| 3,805,901 | 4/1974 | Coski | 175/344 |
| 4,244,433 | 1/1981 | Kellner | 175/53 X |
| 4,258,805 | 3/1981 | Saxman | 175/53 X |
| 4,274,496 | 6/1981 | Liljekvist et al. | 175/344 X |
| 4,359,114 | 11/1982 | Miller et al. | 175/53 X |
| 4,386,670 | 6/1983 | Westermark | 175/344 |

*Primary Examiner*—Ramon S. Britts
*Assistant Examiner*—Frank S. Tsay
*Attorney, Agent, or Firm*—Charles W. Hanor

[57] ABSTRACT

A large shaft over-reamer apparatus and method using a driver means and a detachable reamer cutter means. The driver means may include a work platform for personnel to work on. The driver means is positioned in a drilled pilot hole for stability and vertical control. The top of the driver means is attached to a kelly bar that transmits rotational force to the driver. The driver means has lug pins to releasably connect the driver means to the reamer cutter means. Releasably connecting the driver means to the reamer cutter means allows the reamer cutter means to be left inside the shaft or hole while the kelly bar lifts out excavated material in a bucket attached to the driver means. The reamer cutter has radial cutters and wiper blades. The wiper blades help funnel the excavated materials to a bucket.

30 Claims, 7 Drawing Sheets

LARGE SHAFT OVER-REAMER APPARATUS AND METHOD

FIELD OF THE INVENTION

The present invention relates to an over-reamer apparatus. More particularly, it relates to a large shaft over-reamer apparatus. Specifically, it relates to an over-reamer apparatus that permits high speed drilling of large diameter excavated shafts by leaving the cutting portion of the over-reamer apparatus in the excavated shaft while the kelly bar lifts out the driver and excavated material.

BACKGROUND OF THE INVENTION

The large shaft excavation industry has basically been the domain of the mining and tunneling industry. Typical shaft diameters generally range from a diameter of about than 8 feet to diameters greater than 50 feet. Typical depths of the shafts can be 50 feet to several thousand feet deep.

Some conventional ways of excavating large diameter shafts are as follows. In one conventional method, miners enter the shaft and excavate the material using mechanical equipment such as road headers. In another method, blasting and hand spading or combinations of the above are used.

The excavated material is then loaded into a muck bucket by a small loader or by hand. The bucket is hoisted above the miners to the top of the shaft and is then dumped. The excavating, loading, hoisting and dumping methods are then repeated until the desired diameter and depth of the shaft is reached. During the operation, shaft wall support is added if needed and the cycle is started over.

The foundation drill shaft industry excavates shafts from the surface. The cylindrical shafts may be filled with concrete and reinforcing steel to form structural columns. Shafts may generally range from 12 inches in diameter to 10 feet in diameter. Typical depths may generally range from less than 10 feet and up to 100 feet. The shaft types excavated by both industries may overlap. Drillers may use a large foundation style drill rig to drill larger shafts. The large diameter shafts may be done by first boring or digging a pilot shaft that ranges from 8 to 10 feet in diameter. A drill bucket with over-reamer arms is then attached to a kelly bar which is rotated by a drilling rig. It is used to ream the pilot shaft out to the desired diameter. The cuttings of earth may fall into the bucket which is hoisted up and dumped. The cuttings may also fall into the pilot shaft where they are drilled out with either the bucket without the over-reamer arms or an auger.

This foundation drilling method generally works well. However, is subject to the availability of the drilling force or torque, hoisting capacity and depth. When the rate of advancement of drilling rate decreases to a certain point, then conventional mining techniques may become more competitive.

One of the limitations encountered while using the traditional methods used in the foundation drill shaft industry is the drilling force or torque that is required. The reamer arms of an over-reamer are equipped with drag bits. A drag bit basically cuts and rips the material being excavated. This requires great amounts of drilling force to push the bits into the material and cut away and loosen the material. The longer the reamer arm the more drilling force or torque required. Also, to get cutting action on some of the harder materials, more weight on the bits is needed to cut or loosen the harder material being excavated. This will require more drilling force or torque. The available drilling force or torque at a reasonable revolution per minute requires relatively high horse power and affects the rate of advancement or drilling the hole.

Other limitations involve hoisting and depth capacity. Some of the larger foundation drilling rigs have single line hoisting capacity of about 30,000 to 50,000 lbs. The weight of a rotating kelly bar that is strong enough to deliver enough turning force or torque and long enough in order to reach a desired considerable depth will usually exceed allowable line pulls or hoisting capacity. The weight of the muck or earth being lifted from the hole along with the weight of the bucket and reamer arms further adds to the problem of exceeding allowable line pulls. The deeper the shaft, the heavier the kelly bar. Using multiple part lines on a traveling block generally may limit the kelly bar to a single element kelly. Multiple telescoping kelly bars generally may have a single line going to the inner bar. For deeper holes, the weight of the kelly and reaming tools should be kept to a minimum to avoid excess allowable single line pulls. However, kellys and reamers on big shafts tend to be of heavy construction because of the severe service factor they are subjected to during drilling.

Other limitations with the present methods are those with the reamer arms which are generally all drag cutters. The arms are either fixed or retracted inward when being raised or lowered. Fixed cutters work when no shaft wall support means such as casing, shotcrete, rock anchors, etc. of smaller diameter are added as drilling the shaft progresses deeper.

When shaft wall support is added, the arms need to swing or retract inward in some manner to clear the shaft support means. If personnel are to enter the shaft, then certain utilities may be attached to the shaft wall such as compressed air, water, electricity, lighting and ventilation lines. Reamer arms, fixed or retractable, may damage these lines if they are hit during entry or exit. The tool is visually observed in order to signal the drill operator if the arms are properly retracted or extended or if it appears the arms may come in contact with utility lines. At great depths, it may be hard to visually see the tool, if not impossible, because of distance, lighting and fog or dust concentration arising from excavation.

An object of the present invention is to eliminate or minimize the above mentioned limitations and provide other benefits.

It is an objective of this invention to provide a two-piece over-reamer apparatus so that the entire over-reamer need not be raised from the excavation each time cuttings must be dumped from a bucket.

It is another objective of this invention to minimize the weight that is handled by the hoisting device each time the kelly bar and bucket is raised from the excavation.

It is another object of this invention to allow the part of the over-reamer apparatus to remain in the shaft while hoisting each time the kelly bar and bucket are raised from the excavation.

It is another objective of this invention to minimize the needed turning force required to rotate the over-reamer.

These and other objectives of the invention will be incurred to those skilled in the art in view of the preferred embodiment and the claims.

SUMMARY OF THE INVENTION

The present invention comprises a large shaft over-reamer apparatus and method having a driver, a reamer cutter and a work platform. The top of the driver is attached to a kelly bar and the driver has drive lug pins to detachably secure to the reamer cutter. Through the lug pins, the driver can be engaged and disengaged to the reamer cutter. The driver, when detached from the reamer cutter, can be pulled up onto the surface or it can be moved below the reamer cutter. Making the driver separate from the reamer cutter allows the reamer cutter to remain on bottom and not require hoisting the heavy reamer cutter to the surface on each trip to remove cuttings from the excavation and minimize the hoisting requirements.

The driver is a smaller diameter than the full shaft diameter so it can be hoisted onto the surface without interfering with shaft wall support means or utilities and without requiring visual contact with the driver. The driver can also be used with a work platform. A platform piece or a platform that has multiple pieces can be added to the driver and made somewhat smaller in diameter than the finished shaft excavation to let workers work on the platform. The reamer cutter has rotating cutters and radial wiper blades. The wiper blades help funnel the excavated material into the driver bucket or pilot bore shaft. The rotating radial cutters require less rotating force to rotate the reamer cutter which is important when excavating harder materials. In soft materials, drag cutting bits can be used in place of the rotating cutters. The reamer cutter generally only occupies the area of the shaft outside the pilot bore shaft to leave the pilot bore shaft accessible for cleaning or for further pilot hole excavation. The rotating cutters are radially extendible to allow increasing of the cutting diameter of the over-reamer to make the shaft of a larger diameter.

DESCRIPTION OF THE PREFERRED EMBODIMENT

Figure 1:
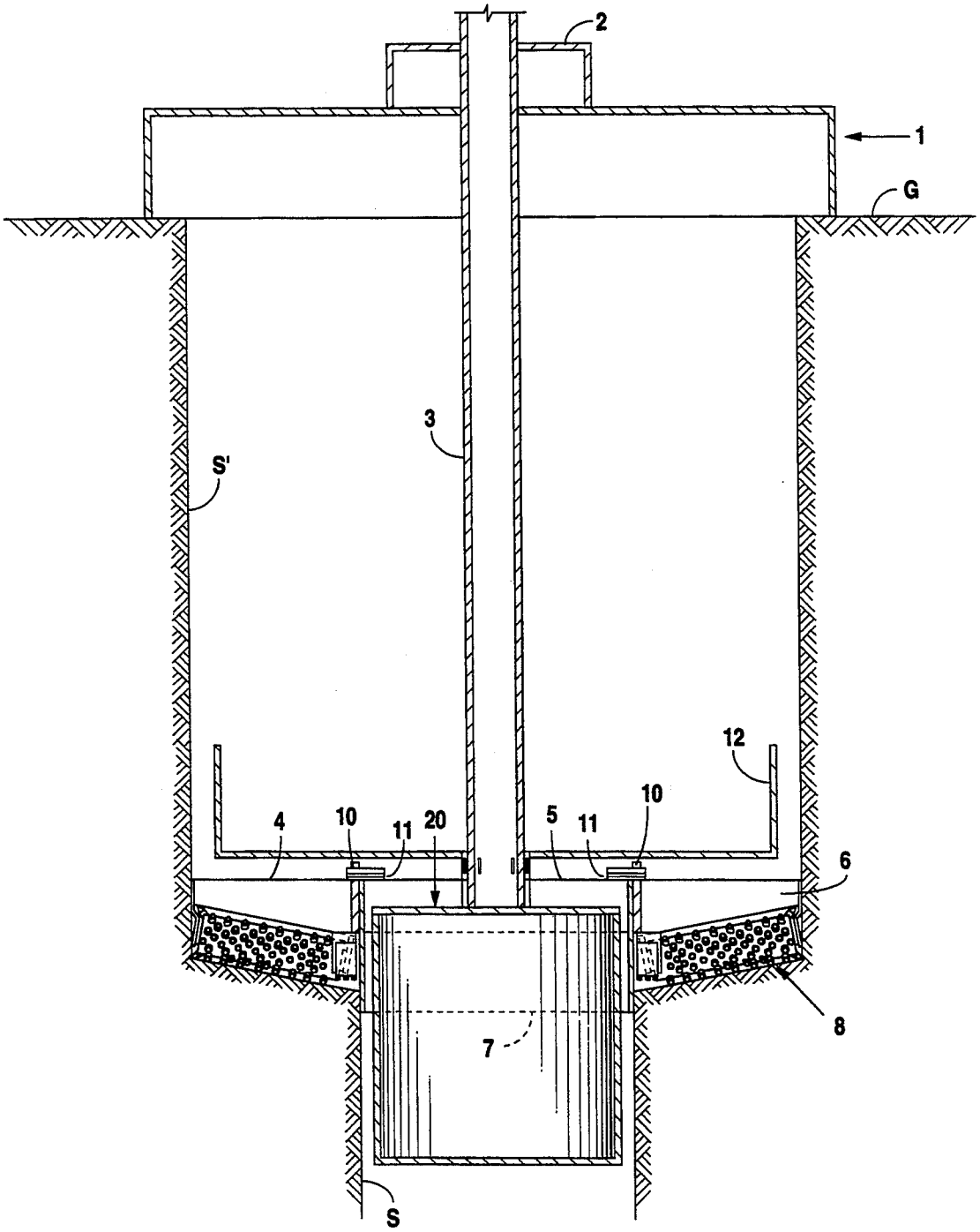
FIG. 1 is an elevation view in partial cross-section showing the general construction of a large shaft using the present invention.

The present invention comprises a large shaft over-reamer apparatus assembly having a two-piece assembly including a driver 5 and a reamer cutter 4 as shown in FIG. 1 and method for using the same. The driver 5 may be cylindrical in shape although other shapes such as octagonal, square, open helical, etc. can be used. The driver 5 may use the pilot hole S to pilot itself for stability and vertical control. The upper portion of the driver 5 is generally attached at its center to kelly bar 3. The outer periphery of driver 5 has drive pins 10 to detachably engage with the reamer cutter 4. The drive lugs or drive pins 10 can also be used to control the downward force on the reamer cutter 4 by either lifting the reamer cutter 4 or applying the weight of the kelly 3 and driver 5 to the reamer cutter 4. The driver 5 is made to receive and hold cuttings for transfer to the surface once it is disengaged. The driver 5 may also allow the cuttings to drop down into the shaft for later removal. The drive pins 10 can be fixed or retractable. Retractable pins 10 are used to lower the driver 5 through and below the reamer cutter 4. A rotating eccentric with levers attached to reciprocating pins may be used to retract drive pins 10. Making the driver 5 separate from the reamer cutter 4 allows the reamer cutter 4 to remain on the bottom during removal of the kelly and driver and not require hoisting the extra weight of the reamer cutter to the surface on each trip. This helps minimize the hoisting requirements. Also, because the driver 5 is of a smaller diameter than the reamer cutter 4, it can be more easily hoisted to the surface without interference with shaft support or utilities. This generally eliminates the need for visual contact during entry and exiting.

The driver 5 can also have a relatively level top surface W suitable for personnel to work and walk on. It can be made part of a work platform 12. A platform 12 can be added to the driver 5 and made smaller in diameter than the finished shaft excavation S'. This platform 12 and driver 5 can be raised and lowered by the kelly bar 3 to the desired work elevation. The kelly bar 3 holding the driver work platform 12 will act as a shield for workers when lowering materials and other things to the platform 12. Also, having the kelly bar 3 support the platform 12 gives the platform 12 better stability over a hoist line suspended platform 12.

Figure 2:
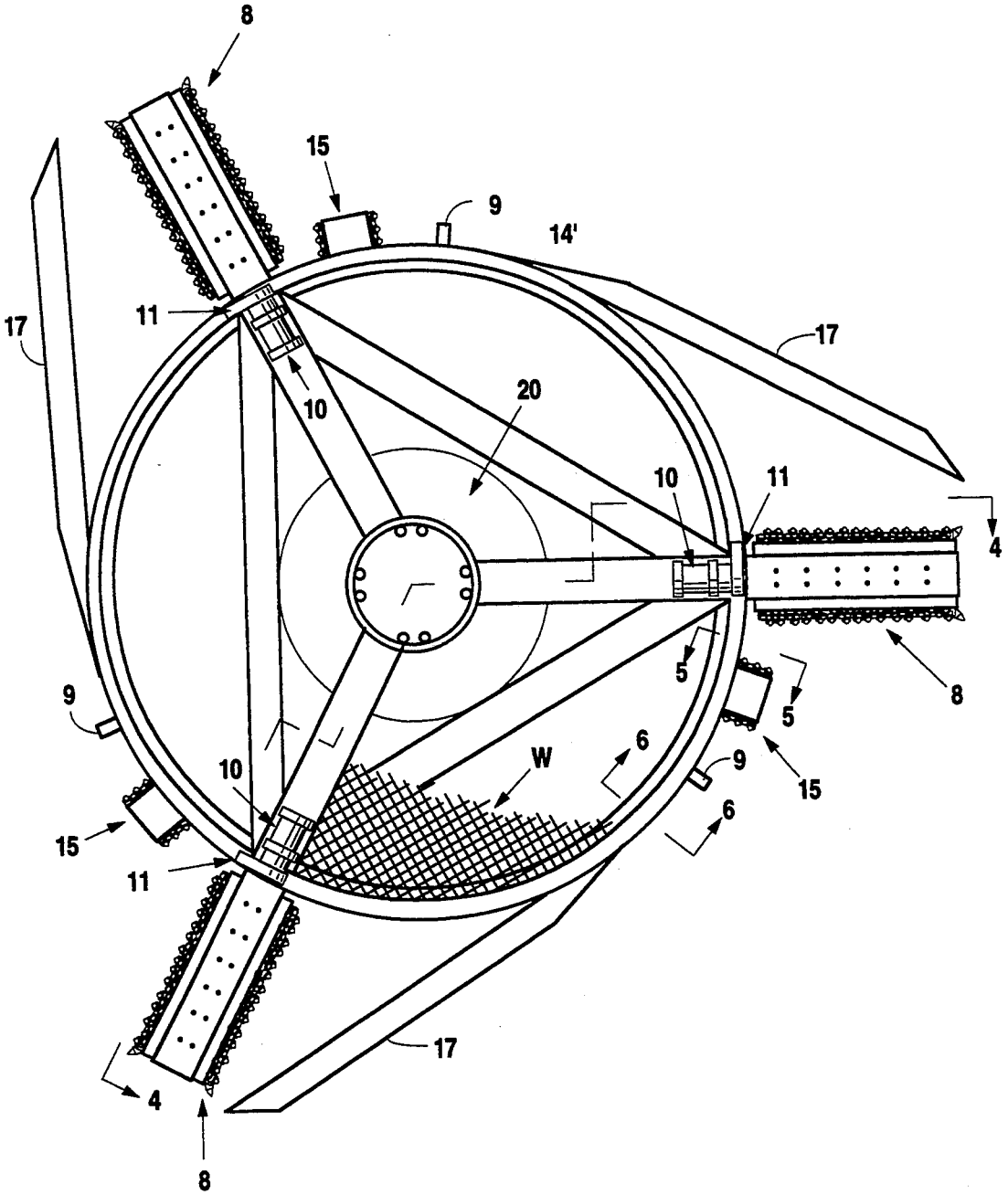
FIG. 2 is a plan view of the over-reamer apparatus according to the present invention.

The reamer cutter 4 has radial cutters 8 and wiper blades 17 as shown in FIG. 2. The wiper blades 17 are needed if rotary bit cutters are used and also help when drag bit cutters are used. The wiper blades 17 help funnel the excavated material into the bucket 7 or pilot hole S of FIG. 1. A rotary bit reamer is generally not used on this type of drilling. Drag bit cutters are believed to be used almost exclusively. An advantage of using a rotary bit is that it takes less rotating force to rotate the reamer cutter 4 especially when there are harder materials. In soft materials, drag bits can be used in place of the rotary bits. Lower torque requirements mean less required kelly bar weight and less horse power per given revolution per minute.

The reamer cutter 4 can also be equipped with more weight attached to it. This may be better than using more kelly weight, especially on deeper shafts. A reason for this is that the kelly can be held in tension to minimize whipping of the kelly during rotation. A kelly may whip badly when it is placed in compression.

The reamer cutter 4 generally only occupies the cross-sectional area of the shaft S' outside the pilot hole S. This leaves the pilot hole S accessible at all times for cleaning of fallen muck or for further pilot hole excavation.

The reamer cutter 4 configuration may comprise a heavy steel ring 14' for supporting radial cutters 8 and wiper blades 17 shown on FIG. 2. The ring's diameter is generally about the same diameter as the pilot hole S. The exact outside diameter of the ring may be slightly smaller than the pilot hole S. This will allow the ring to extend into the pilot hole S for stability and to be maintained vertically.

If the inside diameter of the heavy steel ring 14' is greater than the diameter of the pilot hole S, the driver 5 can be used for stability and vertical control. Attached to the ring 14' are radial arm cutters 8 that are either drag bit cutters or rotary cutters or combinations of the two. As the ring 14' is rotated by the driver 5, the radial arm cutters 8 and wiper blades 17 ream out the hole. The wiper blades 17 are attached to the ring 14' and funnel the loose excavated materials to the pilot shaft S for removal by the bucket 7 or driver/auger. The driver 5 can be operated without a bucket 7 and all the material can fall into the pilot shaft for later removal by a conventional auger or drill bucket. The radial cutter arms 8 can either be adjusted outwardly from the steel ring, can be held in fixed assembly, or can be hinged to the ring so adjustments can be easily made to the cutting angle. If the arms are hinged, means is added to maintain the position of the arms.

Figure 4:
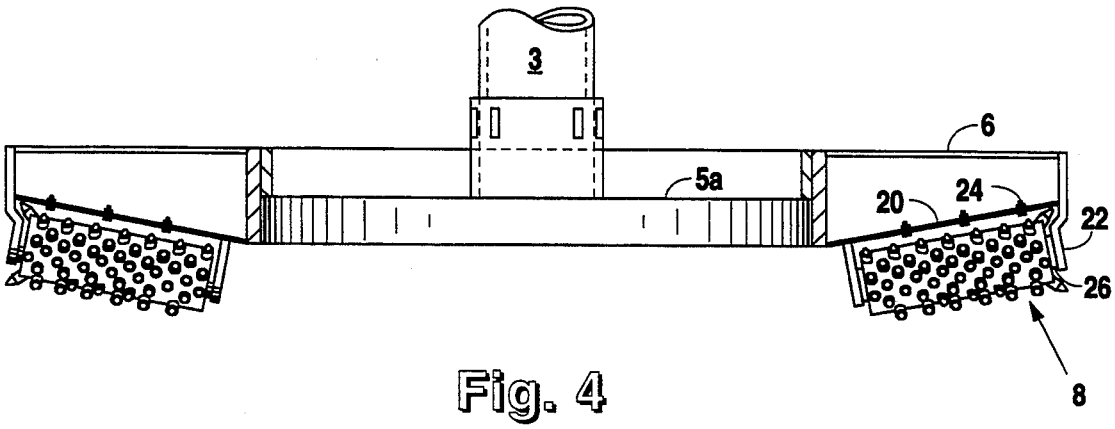
FIG. 4 is a partial cross-sectional view taken along line A—A of FIG. 2.

In operation, the over-reamer apparatus is connected to a kelly bar 3 in order to be lowered into the pilot shaft to increase the diameter of pilot shaft S as shown in FIG. 1. FIG. 1 shows a typical configuration of a device to accomplish this. A base frame 1 is positioned on the ground surface G. Rotary table 2 is supported on base frame 1. A kelly bar 3 extends through the rotary table 2. Rotary table 2 transmits rotational movement or torque to kelly bar 3. An over-reamer apparatus 4 is mounted to the lower end portion of kelly bar 3 that is extended below ground surface G. The kelly bar 3 transmits rotating force to driver 5 and to over-reamer apparatus 4. This increases the diameter of the pilot shaft that is being over-reamed. Cutter support arms 6 which are connected to ring 14', as shown in FIG. 2, each include a radial cutter 8 as shown in FIG. 4. Radial cutters 8 cannot cut all of the material around the pilot. Drag cutters 9 shown in FIG. 2 are positioned along the inner edges of each radial cutter 8 to cut the material adjacent the edge of the pilot shaft S. When used in excavations involving hard materials it may be preferable to use rotary type cutters in place of the drag cutters 9 shown in FIG. 5. The rotational force of driver 5 transmits to cutter support arms 6 to rotate them around the shaft S'. This causes the radial cutters 8 to rotate to scrape off the material of the shaft that is being excavated. Drag cutters 9 drag along and scrape the rest of the material from the surface portion that is not loosened by radial cutters 8. The material that is being scraped may fall into bucket 7 which is attached with the driver 5. Driver 5 is attached to over-reamer apparatus 4 by way of drive pins 10 that attach to drive lugs 11. Once bucket 7 is filled with excavated material, driver 5 can be released from over-reamer apparatus 4. The over-reamer apparatus 4 is left in the shaft S' and driver 5 with bucket 7 is retrieved or lifted to the surface by kelly bar 3 in order to dump the material from bucket 7. The multi-piece platform 12 may be mounted with the driver 5. This multi-piece platform 12 is raised and lowered by kelly bar 3 to do side work on the shaft. The kelly bar 3 may also act as a shield for workers when lowering the materials to the platform 12. The kelly bar 3 gives the platform 12 better stability over a hoist line suspended platform.

FIG. 2 shows a top view of over-reamer apparatus 4. Kelly bar 3 shown in FIG. 1 transmits rotating force to driver 5, which in turn transmits rotating force to over-reamer apparatus 4. Driver 5 is attached through drive pins 10 that engage to driver lugs 11. In order to retrieve driver 5 and kelly bar 3, the kelly bar 3 is slightly rotated in the opposite direction of rotation during drilling so pins 10 will disengage with drive lugs 11. After release, kelly bar 3 and driver 5 can be lifted free of the over-reamer apparatus 4. Cutter support arms 6 with radial cutters 8 have the capability to slide or extend outwardly.

Short radial cutters 15 are attached to the ring 14' between cutters 9 and wiper blades 17. The wiper blades 17 eliminate the need for a slurry circulation system to remove the cuttings. Driver 5 transmits the rotating force to over-reamer apparatus 4 to cause radial cutters 8 and short radial cutters 15 to rotate to scrape the soil or material from the surface being excavated. Since radial cutters 8 are outwardly inclined at an upward angle from the horizontal, radial cutters 8 and short radial cutters 15 will leave behind what is called a holiday or ridge of unexcavated material at the inner edge of the surface being excavated. In order to be able to excavate all the material, drag cutters 9 are positioned to scrape the holiday of unexcavated material. The radial cutters 8, short radial cutters 15 and drag cutters 9 loosen or dig materials from the surface being excavated and wiper blades 17 funnel the loosened material into driver bucket 7 as shown in FIG. 1. The actual construction of bucket 7 is not shown in detail since this is conventional and known in the art. On kelly bar connector 20 (FIG. 1) of driver 5 the platform 12, can be installed above kelly bar connector 20 or the top of driver 5 can be made the center part of platform 12.

Figure 3:
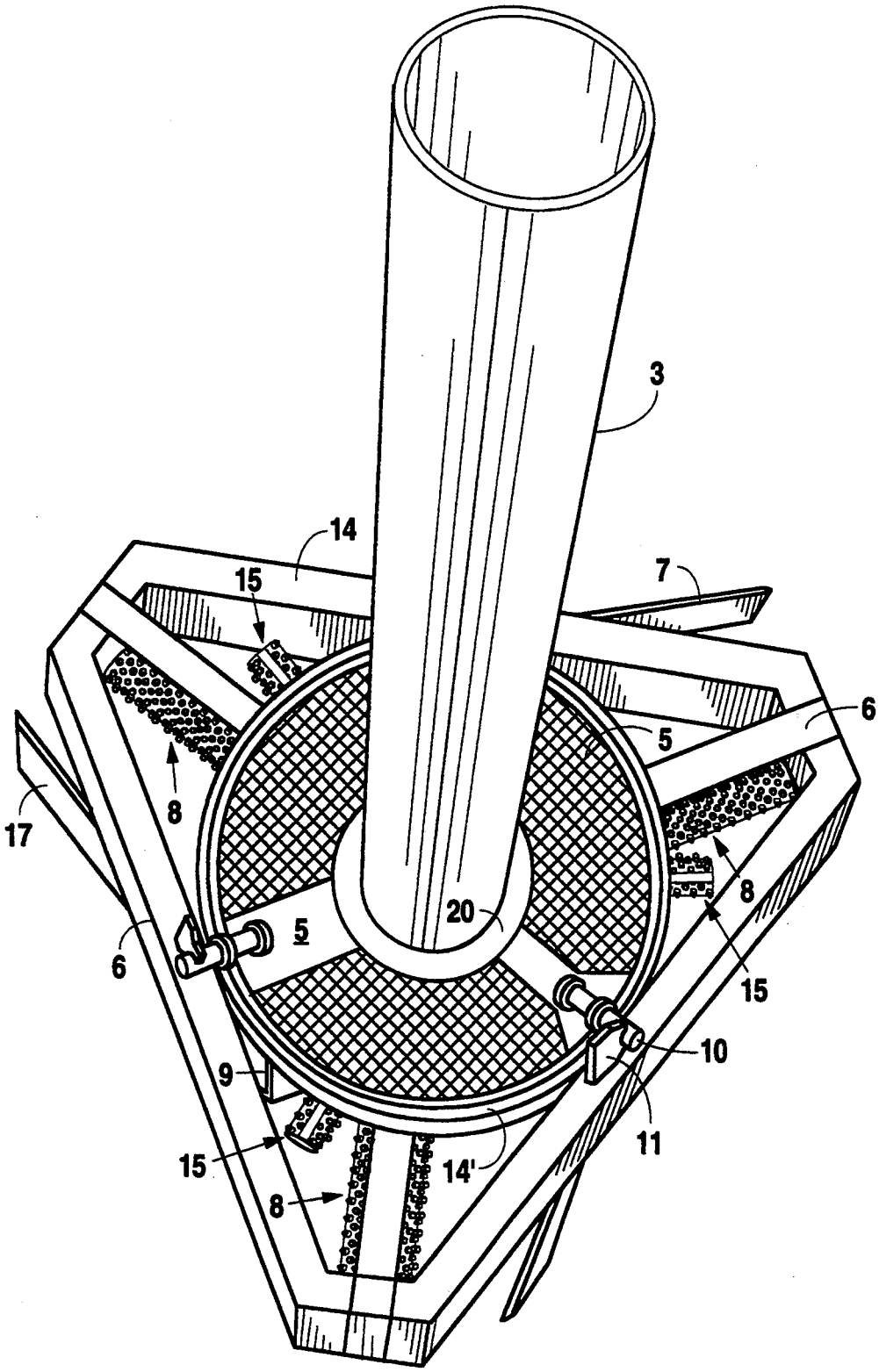
FIG. 3 is a perspective view of the over-reamer apparatus according to the present invention.

FIG. 3 shows a perspective view of another embodiment of the present invention. Kelly bar 3 transmits rotating force to driver 5, which in turn transmits rotating force to ring 14'. Driver 5 is detachably connected to cutter support 6*a* through drive pins 10 engaging drive lugs.

Figure 8:
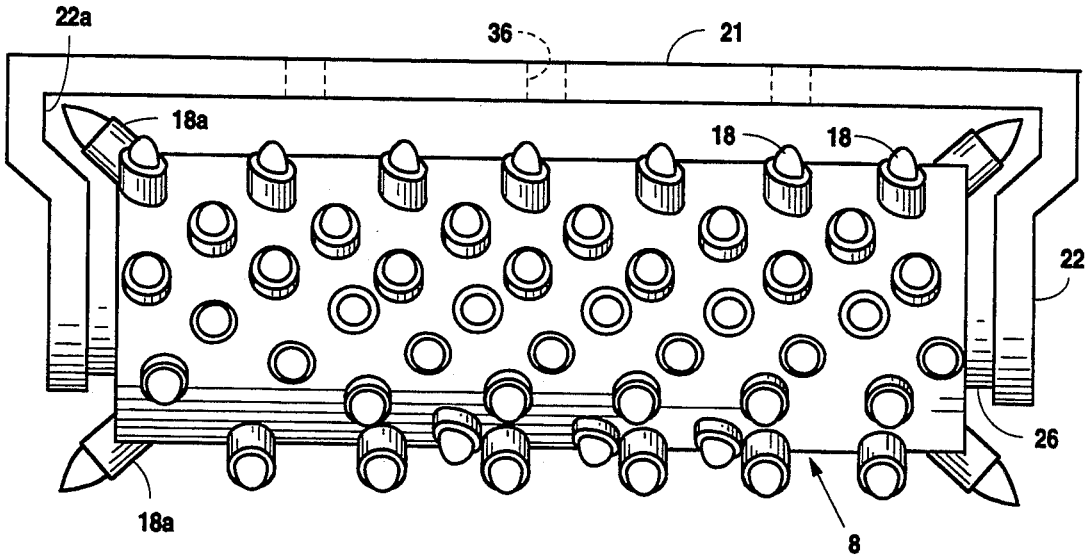
FIG. 8 is a side elevation view of the radial cutter of the present invention.

As shown in FIGS. 4 and 8, radial cutters 8 have the capability to be adjustably moved outwardly to increase the diameter of the over-reamer. A short radial cutter 15 is attached to the ring 14' (FIG. 2) between radial cutters 8 and drag cutters 9.

Figure 7:
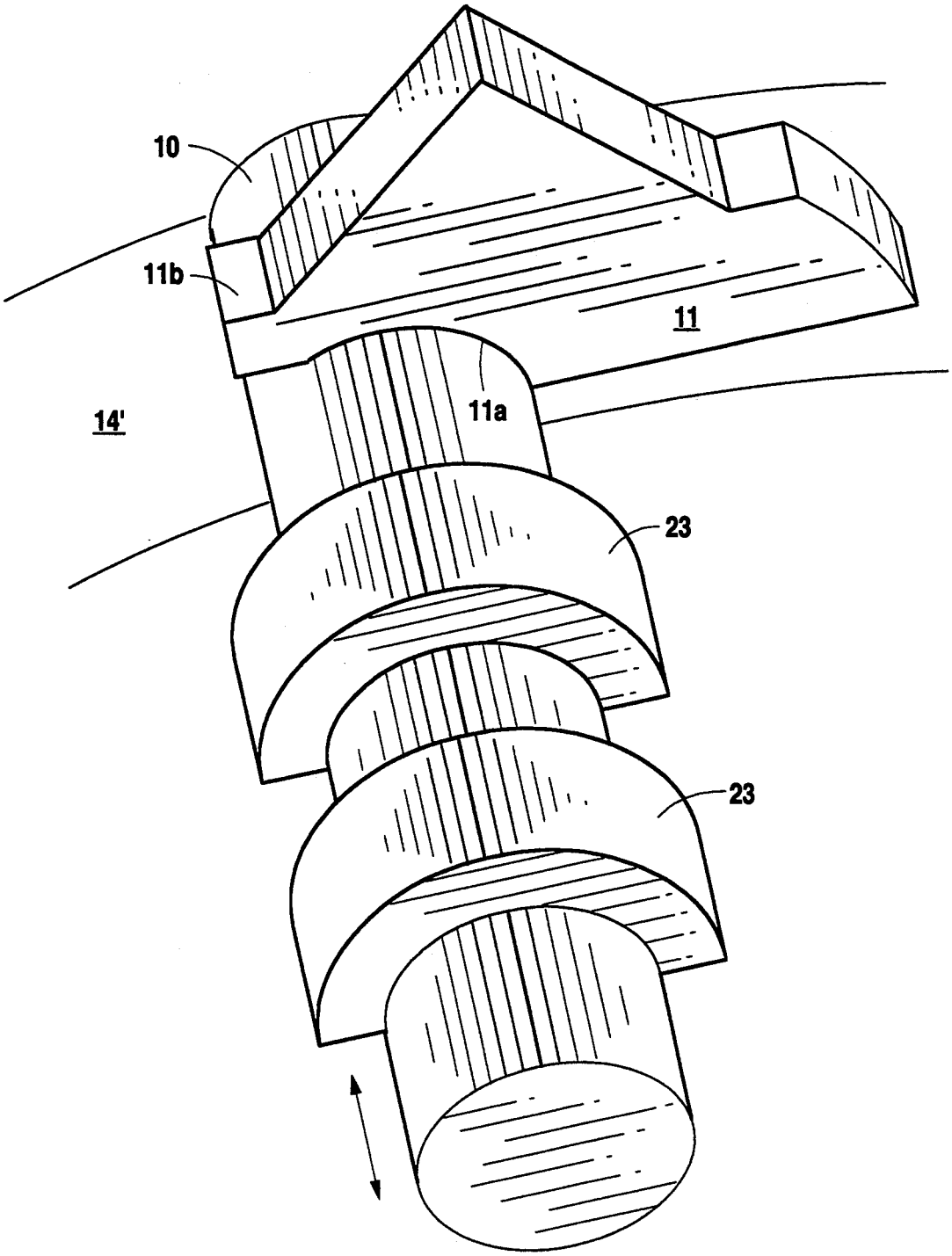
FIG. 7 is a perspective view of the reamer cutter lug and drive lug of the present invention.

As shown in FIG. 7, over-hanging extensions 11*b* extend past and above drive pins 10 to retain the drive pins to ring 14'. In order to detach driver 5 from over-reamer apparatus 4, kelly bar 3 is slightly rotated in a counter-clockwise direction so drive pins 10 can disengage from mating notches or cut outs 11*a* on drive lugs 11. In the released or detached position, drive lug pins 10 are no longer positioned under the over-hanging extensions 11*b*. Kelly bar 3 with driver 5 and bucket 7 can then be lifted from the shaft to dump cuttings from bucket 7. Pins 10 can be made to be retracted so driver 5 can be extended downwardly below reamer cutter 4 if necessary.

FIG. 4 is a partial cross-sectional view taken along line A—A of FIG. 2. Over-reamer apparatus 4 has at least two support arms 6 that have radially extending lower portions 20 with flat support surfaces 24 to which radial cutters 8 are secured. Support surfaces 24 are releasably connected to support surfaces 21 (FIG. 8) which each have a plurality of spaced apertures. A plurality of spaced and mating apertures in support surfaces 24 and 21 allow radial cutters 8 to be radially positioned and then bolted through mating apertures to make the diameter of the over-reamer apparatus 4 larger or smaller. Also, longer radial cutters can be used in order to increase the diameter of the shaft. Radial cutters 8 can be unbolted and moved outwardly and bolted again to the support arms. The radial cutters 8 could be slidably mounted in a track or could be hinged or pivoted so they could be retracted or extended. This would be used for increasing the cutting size of the device or for retracting the cutters and wiper blades for lifting out the excavation.

As shown in FIG. 8, radial cutters 8 have shafts 26 that are connected to generally C-shaped supports 22 with bearings inside the cutter 8. The supports 22 have multiple holes 36 in surface 21 that are designed to attach to the mating plurality of spaced holes in the surface 24 of cutter arm support 6 with removable bolts.

Figure 5:
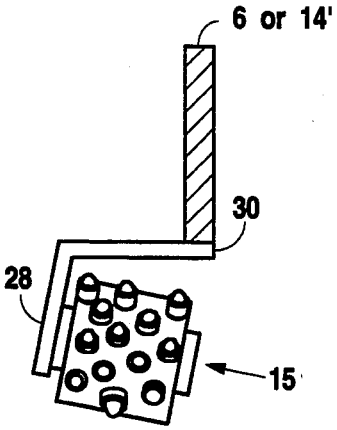
FIG. 5 is a partial cross-sectional view taken along line B—B of FIG. 2.

FIG. 5 shows a view taken along line B—B of FIG. 2. Short radial cutters 15 are non-movable and are welded to ring 14*a* at point 30. Short radial cutters 15 have generally L-shaped supports 28 that are attached to the base of ring 14*a*. The angle of inclination 2 of short radial cutters 15 and radial cutters 8 are generally the same so they can cut on the same contour.

Figure 6:
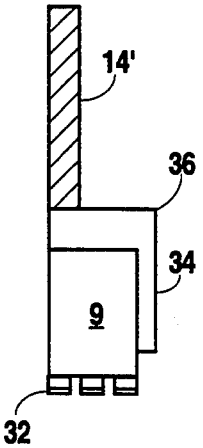
FIG. 6 is a partial cross-sectional view taken along line C—C of FIG. 2.

FIG. 6 shows a partial cross-sectional view taken along line C—C of FIG. 2. All the cutting elements of radial cutters 8 and short radial cutters 15 are radially positioned. Drag cutters 9 are needed in order to excavate the material that is not excavated at the inner edge of short radial cutters 15. Drag cutters 9 have downwardly extending arms 34 and cutting teeth 32. The arms 34 are welded to ring 14*a*.

FIG. 7 shows one of the drive lugs 11 on ring 14' engaged with one of the drive pins 10 of driver 5. Drive pins 10 mate with notches or cut outs 11*a* and overhanging extensions 11*b* that provide for detachable engagement. Pins 10 can retract through brackets 23 so driver 5 can be lowered below reamer cutter 4.

FIG. 8 shows the details of each radial cutters 8. Radial cutters 8 has a plurality of removable hardened cutter bits 18 that cut up the earth that is to be excavated. Radial cutters 8 have shaft 26 that is fixed and attached to C-shaped support 22. Support 22 has a plurality of apertures or holes 36 that permit radial cutters 8 to be selectively bolted onto support arm 6, as shown in FIG. 4. Radial cutters 8 have at their outer end cutter bits 18*a* positioned at each side of radial cutter 8. Cutter bits 18*a* have the function to scrape the area of the ground which is specifically below support 22 in order for support 22 to go down with the rest of the assembly. Since radial cutter 8 is installed in an angle, cutter bits 18*a* scrape the area below support 22. Towards the top of support 22 is outer bend 22*a* that is designed to let cutter bits 18*a* rotate on support 22.

Figure 9:
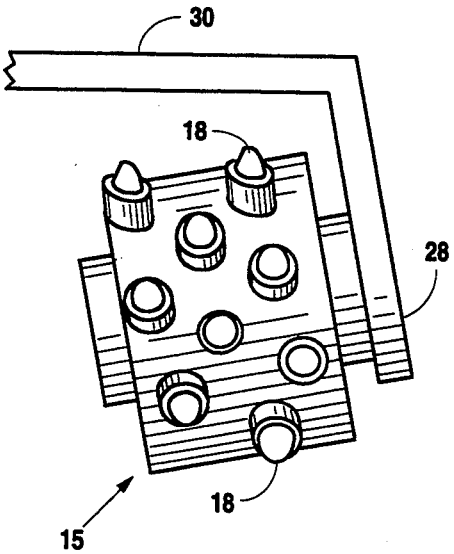
FIG. 9 is a side elevation view of the short cutter of the present invention.

FIG. 9 shows short radial cutter 15. Each short radial cutter 15 has removably hardened cutter bits 18 that cut up the earth. Each has a shaft 28 that is attached to support 30. A conventional sealed bearing is mounted inside cutter 15.

Figure 10:
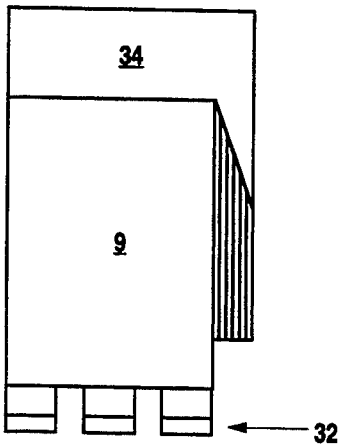
FIG. 10 is a front cross-sectional elevation view of a drag cutter used with the present invention.

FIG. 10 shows the drag cutter 9. At the bottom of drag cutter 9 are hardened cutting teeth or bits 32. Drag cutters 9 have base members 34 that are welded to the lower peripheral edge of ring 14'.

Figure 11:
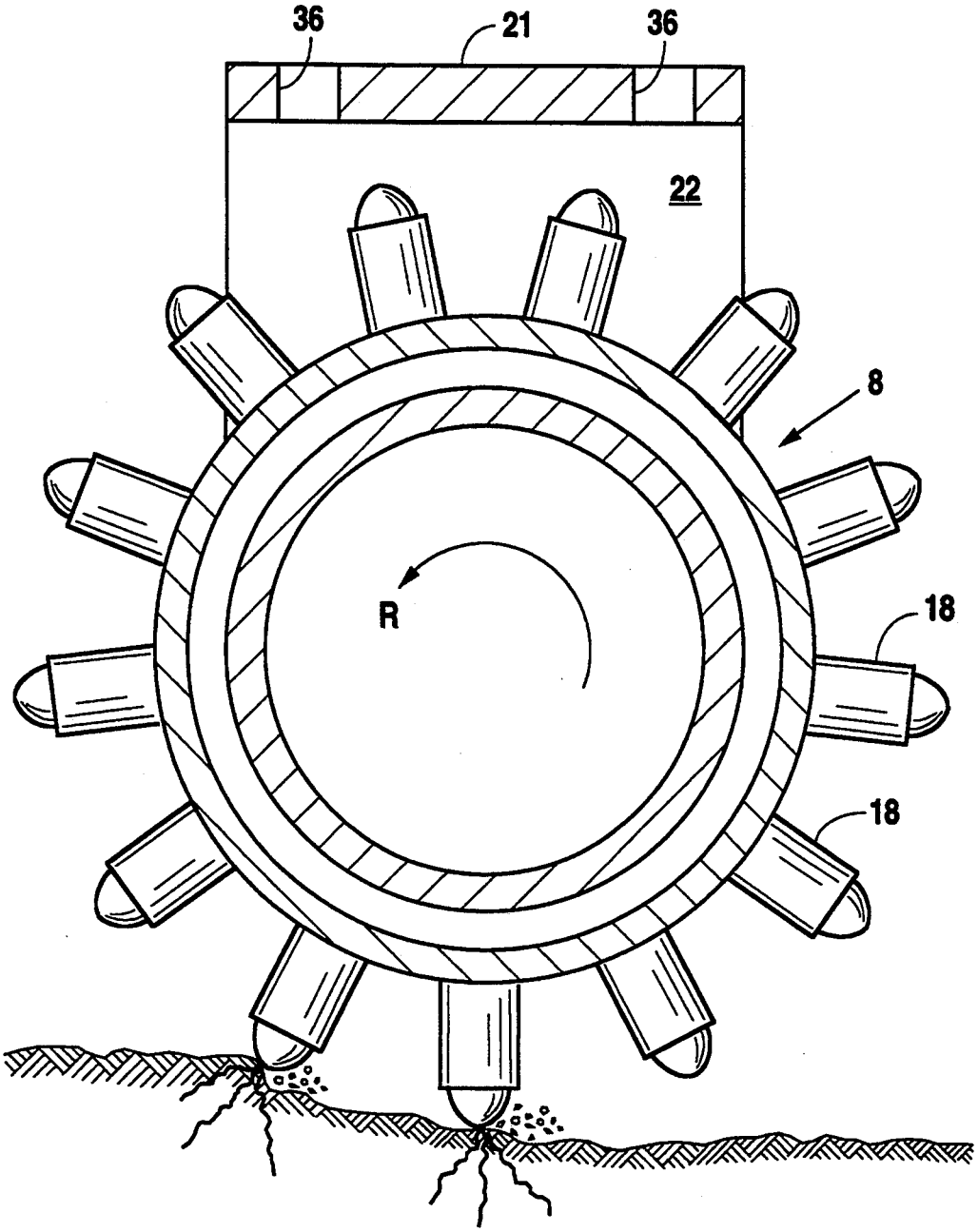
FIG. 11 is a cross sectional view showing the rotary cutter in action.

FIG. 11 shows a radial cutter 8 during excavation. Radial cutters 8 and short radial cutters 15 are forced to penetrate into the earth. At the same time the rotary cutters are rotating in the direction of arrow R in accordance with the turning of over-reamer apparatus 4. Radial cutters 8 and short radial cutters 15 cut with the cutter bits 18. As rotation of the cutter head progresses, cutter bits 18 cut into the earth and loosening it. By repetition of this operation, any rock stratum is broken. The material loosened is funneled by wiper blades 17 into bucket 7, as shown in FIG. 1.

The foregoing is a preferred embodiment of the invention. However, various changes can be made in this system without departing from the scope of the invention. The preferred embodiment should not be interpreted as limiting the scope of the invention or claims.

What is claimed is:

1. A large shaft over-reamer apparatus comprising:

a driver for connecting with a rotating kelly bar for transmitting rotational force to the driver;

an over-reamer cutter having downwardly directed cutters for over-reaming a pilot bore shaft to form a larger shaft having an outer edge; and means mounted on the driver for detachably securing the driver to the over-reamer cutter to allow removal of the driver from the larger shaft while leaving the over-reamer cutter in the larger shaft.

2. The apparatus of claim 1 wherein:

the over-reamer cutter has a plurality of cutters operatively coupled thereto, said cutters being radially movable toward the outer edge of the larger shaft in order to increase the diameter of the over-reamer cutter for increasing the diameter of the larger shaft that is being excavated.

3. The apparatus of claim 1 wherein:

the over-reamer cutter has a plurality of rotating radial cutters operatively coupled thereto for loosening the earth in a shaft.

4. The apparatus of claim 1 wherein:

the over-reamer cutter has a plurality of wiper blades operatively coupled thereto for funneling loosened earth toward the pilot bore shaft for removing the earth in the larger shaft.

5. The apparatus of claim 1 wherein:

the over-reamer cutter has a plurality of rotating radial cutters operatively coupled thereto for loosening the earth in the large shaft, and the over-reamer cutter further has a plurality of wiper blades operatively coupled thereto for funneling loosened earth toward the pilot bore shaft.

6. The apparatus of claim 2 wherein:

the over-reamer cutter has an inner drag cutter operatively coupled thereto to excavate the material that is not loosened by the cutters.

7. A large shaft over-reamer apparatus comprising:

a driver for connecting with a rotating kelly bar for transmitting rotational force to the driver;

an over-reamer cutter having downwardly directed cutters for over-reaming a pilot bore shaft to form a larger shaft having an outer edge;

means mounted on the driver for securing the driver to the over-reamer cutter and to transmit the rotational force from said driver to said over-reamer cutter for over-reaming a pilot bore shaft; and the over-reamer cutter having a plurality of rotating radial cutters operatively coupled thereto for loosening the earth in a shaft.

8. The apparatus of claim 7 wherein:

the over-reamer cutter has a plurality of cutters operatively coupled thereto, said cutters being radially movable in order to increase the diameter of the over-reamer cutter for increasing the diameter of the shaft that is being excavated.

9. The apparatus of claim 7 wherein:

the over-reamer cutter has a plurality of wiper blades operatively coupled thereto for funneling loosened earth toward the pilot bore shaft for removing the earth in the larger shaft.

10. The apparatus of claim 7 wherein:

the over-reamer cutter has a plurality of rotating radial cutters operatively coupled thereto for loosening the earth in the large shaft, and the over-reamer cutter further has a plurality of wiper blades operatively coupled thereto for funneling loosened earth toward the pilot bore shaft.

11. The apparatus of claim 8 wherein:

the over-reamer cutter has an inner drag cutter operatively coupled thereto to excavate the material that is not loosened by the cutters.

12. A large shaft over-reamer apparatus comprising:

a driver;

an over-reamer cutter having downwardly directed cutters for over-reaming a pilot bore shaft to form a larger shaft;

said driver having drive pins mounted thereon to detachably secure the driver to the over-reamer cutter so the driver can be engaged and disengaged to the over-reamer cutter and the driver when detached from the over-reamer cutter can be pulled up onto the surface to allow the over-reamer cutter to remain on bottom and not require hoisting the over-reamer cutter to the surface on each trip to remove cuttings from the excavation and minimize the hoisting requirements and so it can be hoisted onto the surface without interfering with shaft wall support or utilities and without requiring visual contact with the driver.

13. The apparatus of claim 12 wherein:

the driver has a work platform mounted thereon, said work platform being smaller in diameter than the finished shaft excavation to let workers work on the platform.

14. The apparatus of claim 12 wherein:

the over-reamer cutter has rotating radial cutters and radial wiper blades to funnel excavated material into the pilot bore shaft.

15. The apparatus of claim 14 wherein:

the rotating cutters are radially extendible toward the outer edge of the larger shaft to allow increasing of the cutting diameter of the over-reamer cutter.

16. A method for large shaft over-reaming comprising:

connecting a driver with a rotating kelly bar for transmitting rotational force to the driver;

releasably connecting the driver to an over-reamer cutter for over-reaming a pilot bore shaft to form a larger shaft having an outer edge;

detaching the driver from the over-reamer cutter; and removing the driver from the larger shaft while leaving the over-reamer cutter in the larger shaft, thereby allowing the over-reamer cutter to remain in the larger shaft and not require hoisting the over-reamer cutter when removing cuttings from the pilot bore shaft and larger shaft.

17. The method as set forth in claim 16 further comprising the step of:

radially moving cutters on the over-reamer cutter toward the outer edge of the larger shaft in order to increase the diameter of the over-reamer cutter for increasing the diameter of the larger shaft that is being excavated.

18. The method as set forth in claim 16 further comprising the step of:

loosening the earth in the shaft with rotating radial cutters on the over-reamer cutter.

19. The method as set forth in claim 16 further comprising the step of:

funneling loosened earth toward the pilot bore shaft with wiper blades on the over-reamer cutter for removing the earth in the larger shaft.

20. The method as set forth in claim 16 further comprising the step of:

loosening the earth in a shaft with rotating radial cutters on the over-reamer cutter and funneling loosened earth toward a pilot bore shaft with wiper blades on the over-reamer cutter for removing the earth in the larger shaft.

21. The method as set forth in claim 17 further comprising the step of:

excavating the material that is not loosened by the radial cutters with an inner drag cutter on the over-reamer cutter.

22. A method for large shaft over-reaming comprising:

connecting a driver with a rotating kelly bar for transmitting rotational force to the driver;

releasably connecting the driver to an over-reamer cutter with driver pins and drive lugs for over-reaming a pilot bore shaft to form a larger shaft;

lowering and rotating the over-reamer cutter to over-ream the pilot bore shaft thereby creating an excavation; and detaching the driver from the over-reamer cutter to allow removing the driver from the larger shaft while leaving the over-reamer cutter in the shaft.

23. The method as set forth in claim 22 further comprising the step of:

securing a work platform somewhat smaller in diameter than the finished shaft excavation to the over-reamer cutter to let workers work on the platform.

24. The method as set forth in claim 22 further comprising the step of:

loosening the earth in the excavation with rotating radial cutters on the over-reamer cutter and funneling the loosened earth into a bucket with radial wipers on the over-reamer cutter.

25. The method as set forth in claim 22 further comprising the step of:

radially extending the radial cutters to allow increasing of the cutting diameter of the over-reamer cutter to make the shaft of a larger diameter.

26. A method for large shaft over-reaming comprising:

connecting a driver with a rotating kelly bar for transmitting rotational force to the driver;

connecting the driver to an over-reamer cutter for over-reaming a pilot bore shaft to form a larger shaft;

lowering and rotating the over-reamer cutter to over-ream the pilot bore shaft;

radially moving cutters outwardly on the over-reamer cutter in order to increase the diameter of the over-reamer cutter for increasing the diameter of the shaft that is being excavated; and detaching the driver from the over-reamer cutter to allow removing the driver from the larger shaft while leaving the over-reamer cutter means in the shaft.

27. The method as set forth in claim 26 further comrpising the step, of:

loosening the earth in the shaft with rotating radial cutters on the over-reamer cutter.

28. The method as set forth in claim 26 further comprising the step of:

funneling loosened earth toward the pilot bore shaft with wiper blades on the over-reamer cutter for removing the earth in the larger shaft.

29. The method as set forth in claim 26 further comprising the step of:

loosening the earth in a shaft with rotating radial cutters on the over-reamer cutter and funneling loosened earth toward a pilot bore shaft with wiper blades on the over-reamer cutter for removing the earth in the larger shaft.

30. The method as set forth in claim 27 further comprising the step of:

excavating the earth that is not loosened by the radial cutter means with an inner drag cutter on the over-reamer cutter.

* * * * *